US011208182B2

(12) United States Patent
Daley et al.

(10) Patent No.: US 11,208,182 B2
(45) Date of Patent: Dec. 28, 2021

(54) THRU HULL WITH REMOVABLE DRAINAGE DEVICE

(71) Applicant: C&D Marine Products, LLC, Clinton, TN (US)

(72) Inventors: Colin Daley, Clinton, TN (US); Tony Williams, Alcoa, TN (US); Bradley M. Nemeth, Wilton Manors, FL (US)

( * ) Notice: Subject to any disclaimer, the term of this patent is extended or adjusted under 35 U.S.C. 154(b) by 0 days.

(21) Appl. No.: 16/789,493

(22) Filed: Feb. 13, 2020

(65) Prior Publication Data

US 2021/0253204 A1 Aug. 19, 2021

(51) Int. Cl.
*B63B 59/04* (2006.01)
*B63B 13/00* (2006.01)

(52) U.S. Cl.
CPC ..... *B63B 59/04* (2013.01); *B63B 13/00* (2013.01)

(58) Field of Classification Search
CPC ..... B63B 59/00; B63B 59/04; B63B 13/00; B63B 13/02; B63B 19/00; B63B 19/26
USPC ..... 114/182
See application file for complete search history.

(56) References Cited

U.S. PATENT DOCUMENTS

| | | | | |
|---|---|---|---|---|
| 6,164,231 | A * | 12/2000 | Shimmell | B63B 13/02 114/182 |
| 7,549,384 | B2 * | 6/2009 | Nagler | B63B 13/00 114/182 |
| 9,919,766 | B2 * | 3/2018 | Daley | B63B 59/04 |
| 10,625,823 | B2 * | 4/2020 | Daley | B63B 13/02 |
| 10,780,951 | B2 * | 9/2020 | Daley | B63B 59/04 |
| 2010/0294186 | A1 * | 11/2010 | Tung | B63B 19/26 114/182 |
| 2020/0255096 | A1 * | 8/2020 | Daley | B63B 13/02 |

* cited by examiner

*Primary Examiner* — Lars A Olson
(74) *Attorney, Agent, or Firm* — Robinson IP Law, PLLC

(57) ABSTRACT

A device for preventing staining of a boat hull includes: a thru hull mounted through the boat hull, the thru hull including a thru hull body, a flange located on an end of the thru hull body, and a lip protruding from a face of the flange; a drainage device mountable on the thru hull, the drainage device including a drainage device body, an inwardly projecting rim located at least partially around the drainage device body, and a drainage lip protruding from the drainage device body. The inwardly projecting rim is shaped such that the drainage device is secured on the thru hull by locating the inwardly projecting rim around at least a portion of the lip protruding from the face of the flange of the thru hull.

20 Claims, 7 Drawing Sheets

THRU HULL WITH REMOVABLE DRAINAGE DEVICE

FIELD

This disclosure relates to the field of marine and boating accessories. More particularly, this disclosure relates to accessories for preventing buildup of drainage streaks on a hull of a vessel.

BACKGROUND

Boats and marine vessels are often fitted with thru-hull fittings that extend through a hull of the vessel to allow for discharge of a fluid from the vessel. These thru-hull fittings are typically mounted flush with a surface of the vessel's hull. Thru-hull fittings provide a drainage point for fluids discharged from the boat, such as for a bilge pump, live well, or other pump or fluid source on the boat.

When a fluid is discharged from the thru-hull fitting, at least a portion of the fluid drains along a surface of the vessel's hull given the flush-mounted position of the thru-hull fitting. As the fluid drains down a surface of the vessel's hull, the fluid often stains the hull of the vessel and leaving behind discolored streaks on the hull, as shown in FIG. 1. These streaks build up over time, and removal of the staining or streaks caused by drainage of fluid from the thru-hull fitting is extremely difficult.

Attempts have been made to direct fluid exiting a thru-hull fitting away from a vessel's hull. For example, attempts have been made to attach a drainage channel with a gasket to direct fluid away from the vessel's hull. Further attempts involve replacing the thru-hull fitting itself with a shaped fitting that attempts to direct fluid away from the hull. These attempts often do not adequately divert water away from the hull and are otherwise difficult to install. These devices are also typically inflexible and subject to breaking if the hull contacts a dock or other surface.

What is needed, therefore, is a boat thru-hull fitting and drainage device that is readily installed on the hull of the boat to direct discharge fluid from the thru-hull fitting away from the hull. What is further needed is an ability replace at least portions of a drainage device installed on a hull of the boat.

SUMMARY

The above and other needs are met by a boat thru-hull fitting and drainage device that is readily installed on the hull of the boat to direct discharge fluid from the thru-hull fitting away from the hull. In a first aspect, a device for preventing staining of a boat hull includes: a thru hull mounted through the boat hull, the thru hull including a thru hull body, a flange located on an end of the thru hull body, and a lip protruding from a face of the flange; a drainage device mountable on the thru hull, the drainage device including a drainage device body, an inwardly projecting rim located at least partially around the drainage device body, and a drainage lip protruding from the drainage device body. The inwardly projecting rim is shaped such that the drainage device is secured on the thru hull by locating the inwardly projecting rim around at least a portion of the lip protruding from the face of the flange of the thru hull.

In one embodiment, the device further includes one or more inwardly projecting tabs located around the drainage device body. In another embodiment, the thru hull is formed of one of stainless steel and a hardened polymer. In yet another embodiment, the drainage device is formed of a thermoplastic elastomer. In one embodiment, the drainage device is formed of Santoprene.

In another embodiment, the device further includes a groove located between the lip protruding from the face of the flange and the flange, wherein the inwardly projecting rim fits within the groove when the drainage device is installed on the thru hull. In yet another embodiment, the device further includes a downward projecting portion located on an underside of the drainage lip at an end of the drainage lip.

In one embodiment, the device further includes a drainage groove located on the drainage lip protruding from the drainage device body. In another embodiment, a diameter of the lip is greater than an outer diameter of the groove. In yet another embodiment, the device further includes an angled surface located between the lip protruding from the face and the groove.

In one embodiment, an inner diameter of the lip around an outlet of the thru hull is angled such that a diameter of the outlet increases towards a distal end of the lip. In another embodiment, a diameter of the lip is less than an outer diameter of the flange.

In yet another embodiment, the device further includes a threaded portion located on the thru hull body. In one embodiment, the device further includes a nut threadably engageable with the threaded portion located on the thru hull body for securing the thru hull body to the boat hull.

In another embodiment, the device further includes a flexible washer, wherein the flexible washer is located between an inner surface of the flange and the boat hull when the thru hull is installed on the boat hull. In yet another embodiment, the thru hull further includes a barbed portion located on an opposite end of the thru hull body from the flange. In one embodiment, the barbed portion further includes a slot formed therein. In another embodiment, the barbed portion is secured to a conduit on the boat, and wherein a fluid from the conduit flows through the thru hull and is discharged on the drainage device at an outlet of the thru hull.

In a second aspect, a device for preventing staining of a boat hull includes: a thru hull mounted through the boat hull, the thru hull including a thru hull body, a flange located on an end of the thru hull body, and a lip protruding from a face of the flange; a drainage device mountable on the thru hull, the drainage device including a drainage device body, an inwardly projecting rim located at least partially around the drainage device body, one or more inwardly projecting tabs located around the drainage device body, and a drainage lip protruding from the drainage device body. The inwardly projecting rim is shaped such that the drainage device is secured on the thru hull by locating the inwardly projecting rim around at least a portion of the lip protruding from the face of the flange of the thru hull.

In a third aspect, a device for preventing staining of a boat hull includes: a thru hull mounted through the boat hull, the thru hull including a thru hull body, a flange located on an end of the thru hull body, a lip protruding from a face of the flange, and a groove formed between the lip protruding from the face of the flange and the flange; a drainage device mountable on the thru hull, the drainage device including a drainage device body, an inwardly projecting rim located at least partially around the drainage device body, and a drainage lip protruding from the drainage device body. The inwardly projecting rim is shaped such that the drainage device is secured on the thru hull by locating the inwardly projecting rim around at least a portion of the lip protruding from the face of the flange of the thru hull. The inwardly projecting rim is shaped to fit within the groove of the thru hull when the drainage device is installed on the thru hull.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
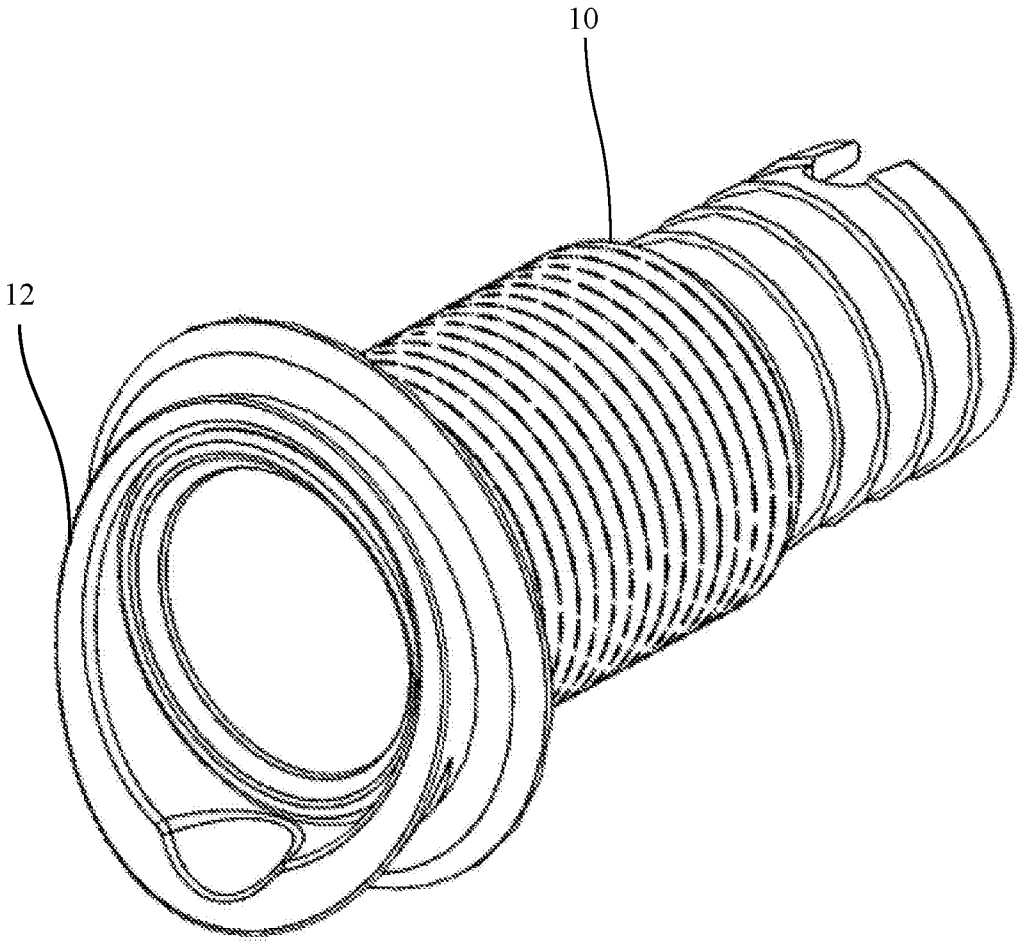
FIG. 1 shows a perspective view of a thru hull and drainage device according to one embodiment of the present disclosure.
Figure 2:
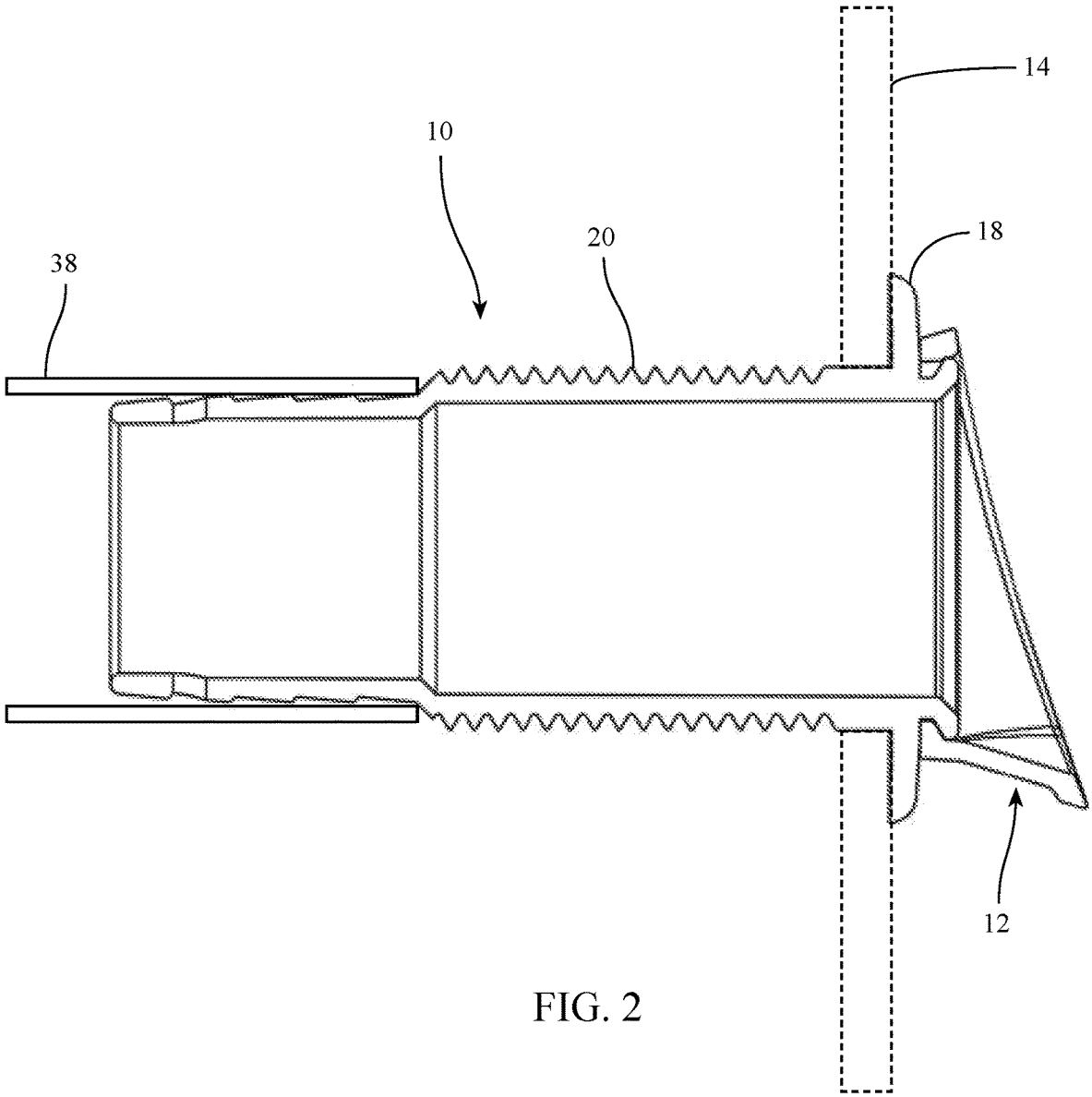
FIG. 2 shows a cross-sectional side view of a thru hull and drainage device according to one embodiment of the present disclosure.

FIG. 1 shows a basic embodiment of a thru hull 10 including a drainage device 12 removably secured thereon. The thru hull 10 is preferably installed on a boat or other vessel, such as through a hull 14 (FIG. 2) of the boat or vessel. The thru hull 10 is preferably in fluid communication with a hose or conduit within the hull 14 of the boat such that a fluid from the hose or conduit is discharged from the boat or vessel through the thru hull 10. The drainage device 12 is removably secured on the thru hull 10 such that the drainage device 12 may be readily installed on or removed from the thru hull 10 and such that various drainage devices 12 may be installed on the thru hull 10.

Figure 3A:
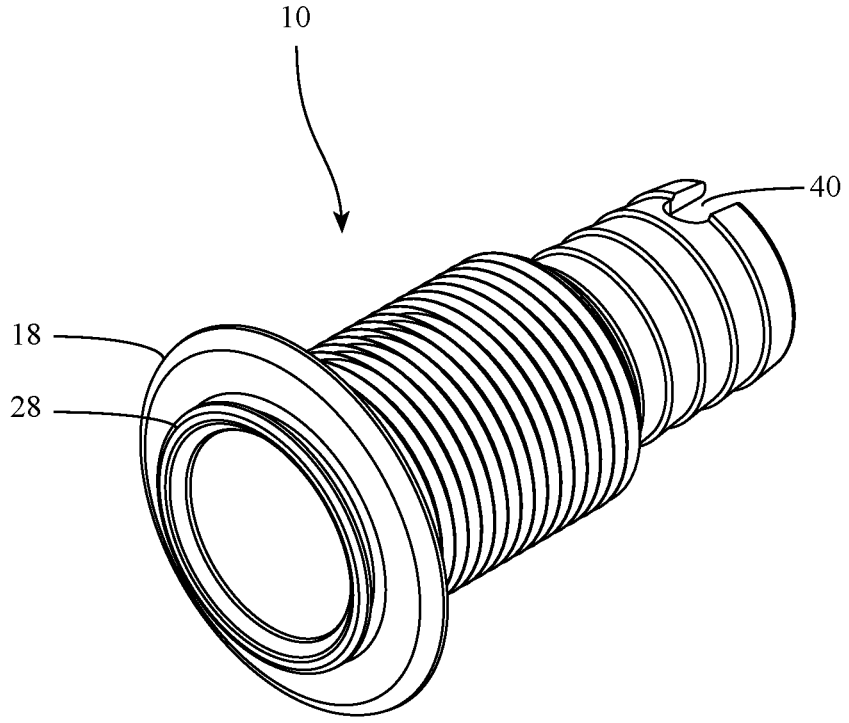
FIG. 3A shows a perspective view of a thru hull according to one embodiment of the present disclosure.
Figure 3B:
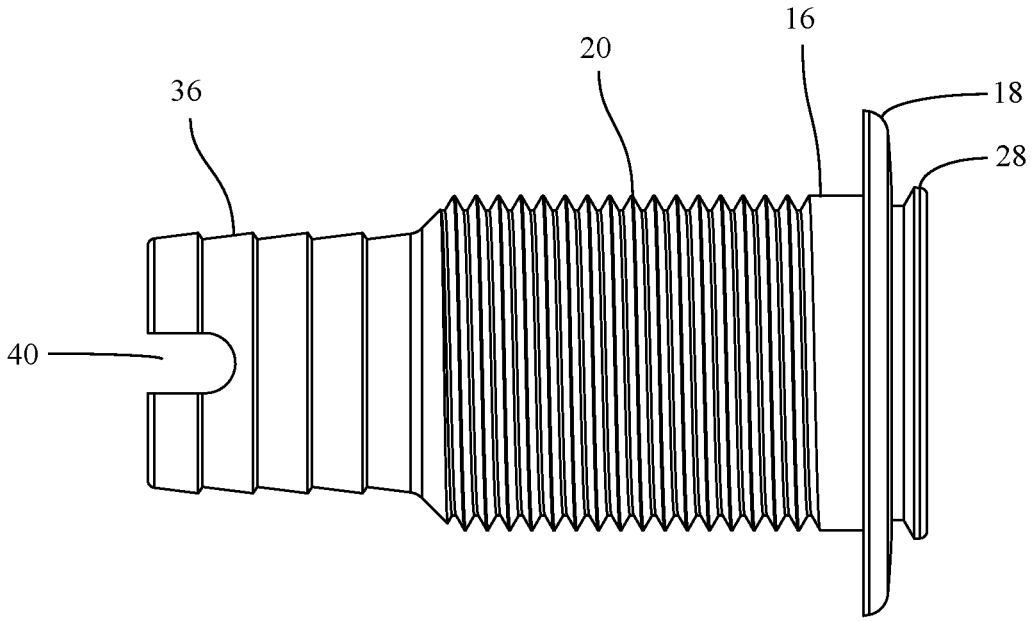
FIG. 3B shows a side view of a thru hull according to one embodiment of the present disclosure.
Figure 3C:
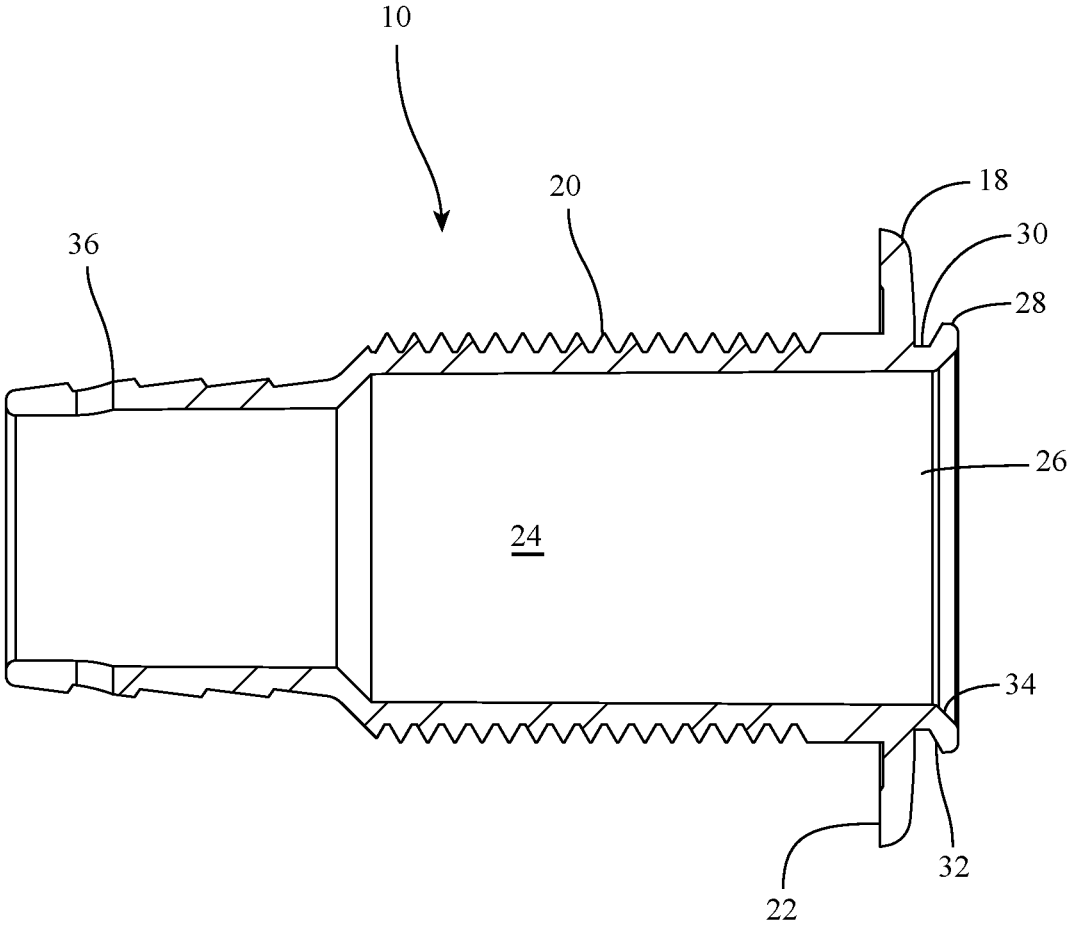
FIG. 3C shows a cross-sectional side view of a thru hull according to one embodiment of the present disclosure.
Figure 4:
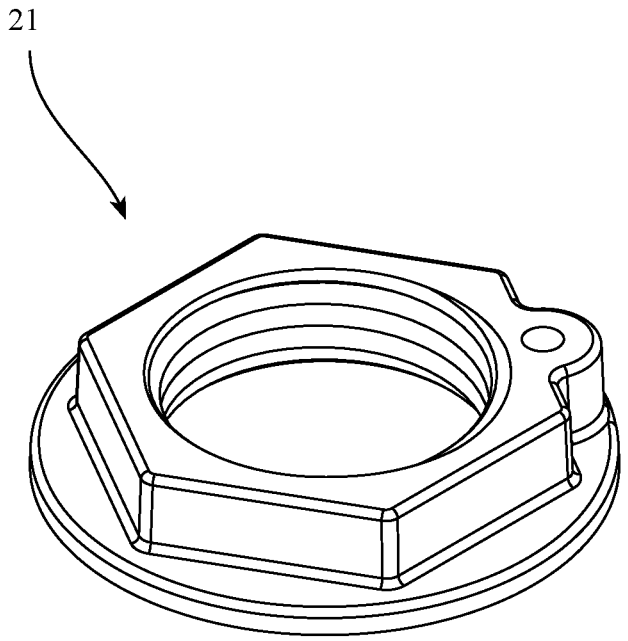
FIG. 4 shows a perspective view of a nut according to one embodiment of the present disclosure.
Figure 5A:
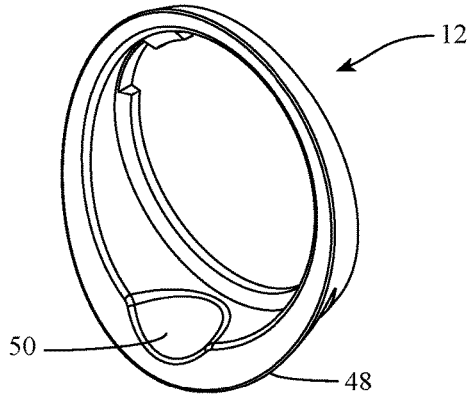
FIG. 5A shows a front perspective view of a drainage device according to one embodiment of the present disclosure.
Figure 5B:
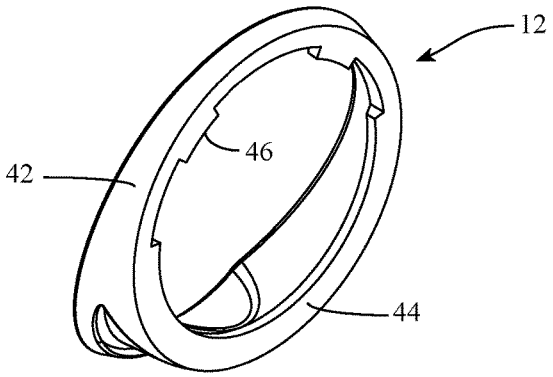
FIG. 5B shows a rear perspective view of a drainage device according to one embodiment of the present disclosure.
Figure 5C:
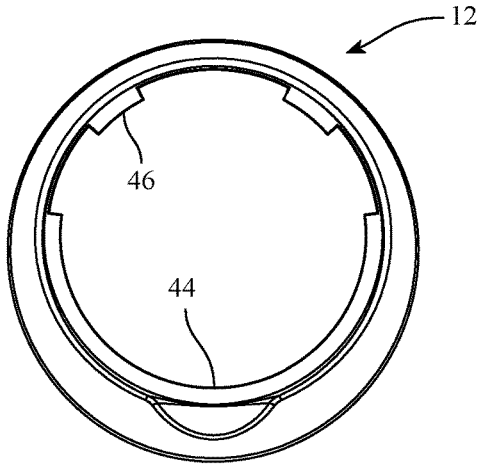
FIG. 5C is a front view of a drainage device according to one embodiment of the present disclosure.
Figure 5D:
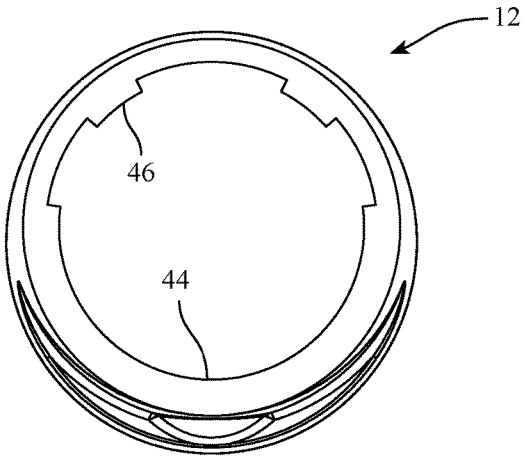
FIG. 5D is a rear view of a drainage device according to one embodiment of the present disclosure.
Figure 5E:
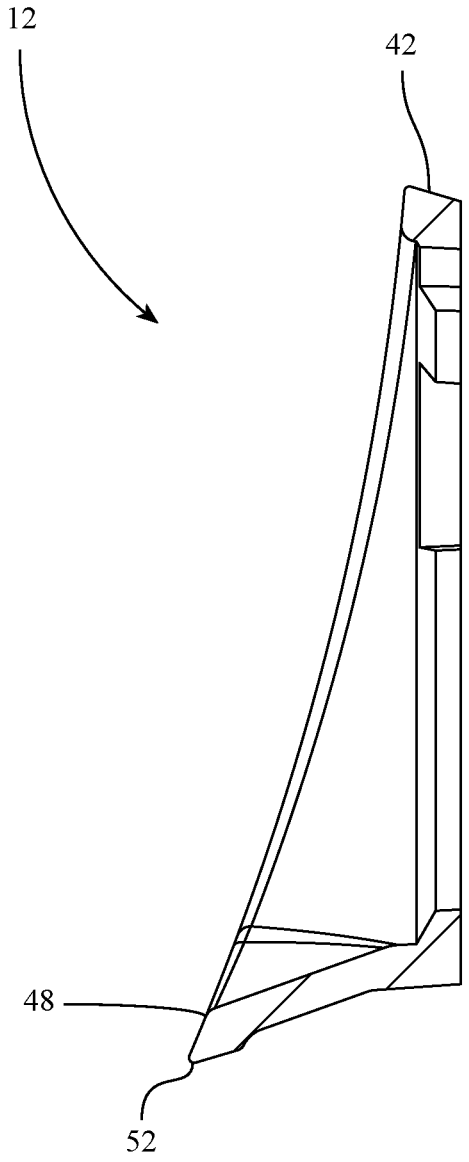
FIG. 5E is a cross-sectional side view of a drainage device according to one embodiment of the present disclosure.

Referring to FIGS. 3A-3C, the thru hull 10 includes a thru hull body 16 including a flange 18 located on an end thereof. The thru hull body 16 preferably includes a threaded portion 20 located around at least a portion of the thru hull body 16. The threaded portion 20 is preferably shaped to receive a nut 21 (FIG. 4) or other fastener thereon to secure the thru hull 10 to the hull of a boat or vessel. The flange 18 is preferably formed on an end of the thru hull body 16 and is shaped such that an inner surface 22 of the flange 18 is located flush against an outer surface of the hull 14 (FIG. 2) when the thru hull 10 is installed. A passage 24 is formed through a center of the thru hull body 16 and flange 18 such that fluid may pass therethrough. The passage 24 terminates at an outlet 26 formed at an end of the thru hull 10 such that fluid passing through the thru hull 10 exits the thru hull 10 at the outlet 26. The thru hull 10 is preferably formed of a metal, such as stainless steel, or hardened plastic.

Referring to FIG. 3C, the thru hull 10 further includes a lip 28 protruding from an outward face of the flange 18 of the thru hull 10. The lip 28 is preferably flared outwardly away from the outlet 26 formed in the thru hull 10 such that a groove 30 is formed between the lip 28 and the outward face of the flange 18. An inner edge 32 of the lip 28 extending between the groove and an outer diameter of the lip 28 is preferably sloped, as shown in FIG. 3C. The lip 28 is preferably shaped such that an outer diameter of the lip 28 is greater than a diameter of the groove 30 located between the lip 28 and the outward face of the flange 18. A diameter of the lip 28 is preferably less than an outer diameter of the flange 18 of the thru hull 10. An inner diameter 34 of the lip 28 is preferably sloped such that a diameter of the outlet 26 increases towards a distal end of the outlet 26.

The thru hull 10 further may include a barbed end 36. The barbed end 36 of the thru-hull is preferably shaped to receive a hose 38 or other conduit on a boat or vessel such that fluid flowing through the hose 38 flows into the passage 24 of the thru hull 10 and out of the outlet 26 of the thru hull 10. The barbed end 36 may optionally include a cutout 40 formed therein such that at least a portion of the barbed end 36 may flex when inserting the barbed end 36 into the hose 38.

Referring now to FIGS. 5A-5E, the drainage device 12 is shaped such that the drainage device 12 is removably installable on the lip 28 of the thru hull 10 to convey water from the outlet 26 of the thru hull 10 away from a surface of a hull of the boat on which the thru hull 10 is installed. The drainage device 12 includes a drainage device body 42. The drainage device body 42 is preferably circular in shape with an open middle portion for fitting around the thru hull 10 as described in greater detail herein. The drainage device body 42 preferably includes an inwardly projecting rim 44 located at least partially around the drainage device body 42. For example, as shown in FIGS. 5A-5E, the inwardly projecting rim 44 may be formed along a lower half of the drainage device 42 while one or more inwardly projecting tabs 46 are located along an upper half of the drainage device 42. Alternatively, the inwardly projecting rim 44 may be substantially continuously formed around the drainage device 42. The inwardly projecting rim 44 has a height and thickness such that the projecting rim 44 and the one or more inwardly projecting tabs 46 fit within the groove 30 located between the lip 28 and the outward face of the flange 18 of the thru hull 10 when the drainage device 12 is installed on the thru hull 10.

With further reference to FIGS. 5A-5E, the drainage device 12 further includes a drainage lip 48 projecting from the drainage device body 42. The drainage lip 48 is preferably shaped such that the drainage lip 48 conforms to a shape of the drainage device body 42. The drainage lip 48 preferably extends to a maximum distance from the drainage device body 42 at a bottom portion of the drainage lip 48. Embodiments of the drainage lip 48 further preferably include a groove 50 formed at a bottom of the drainage lip 48 towards a distal end of the drainage lip 48. Embodiments of the drainage lip 48 further include an optional downward projecting portion 52 located on an underside of the drainage lip 48.

The drainage device 12 is preferably formed of a resiliently flexible material, such as a thermoplastic elastomer. In one preferably embodiment, the drainage device 12 is formed of a material provided under the trade name Santoprene™. The drainage device 12 is formed such that the drainage device 42 is preferably flexible relative to the lip 28 of the thru hull 10.

To install the thru hull 10 and drainage device 12 on a boat, the thru hull 10 is preferably installed at a bore formed through a hull of the boat. The thru hull 10 is installed such that the flange 18 of the thru hull 10 is flush with an outer surface of the hull of the boat. The thru hull 10 is secured to the hull of the boat, such as with the nut 21 secured on the threaded portion 20 of the thru hull body 16. The drainage device 12 may be removably secured on the thru hull 10. The thru hull 10 may optionally include a flexible washer, such as a washer formed of polyurethane, located between the flange 18 and the hull of the boat.

To secure the drainage device 12 to the thru hull 10, the drainage device body 42 is stretched such that the inwardly projecting rim 44 of the drainage device body 42 is located within the groove 30 formed adjacent the lip 28. The inwardly projecting rim 44 and optional one or more inwardly projecting tabs 46 rest against the groove 30, thereby securing the drainage device 12 to the thru hull 10. To remove the drainage device from the thru hull 10, at least a portion of the drainage device body 42 may be pulled to disengage one of the inwardly projecting rim 44 and the one or more inwardly projecting tabs 46 from the groove 30.

Embodiments of the thru hull 10 and drainage device 12 described herein advantageously enable the drainage device 12 to be removably installed on the thru hull 10, thereby allowing the drainage device 12 to be installed, replaced, or repaired without requiring removal of the thru hull 10. Embodiments herein further enable the drainage device 12 to be removed or installed from a boat without requiring an adhesive or specialized tools for installation or removal. Various types of the drainage device 12, such as varying shapes, sizes, or colors, may be installed on the thru hull 10. Further, the drainage device may be removed or replaced to repair a damaged or lost drainage device 12.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A device for preventing staining of a boat hull comprising:

a thru hull mountable through the boat hull, the thru hull including a thru hull body, a flange located on an end of the thru hull body, and a lip located around an outlet of the thru hull, the lip protruding outwardly from a face of the flange and away from the boat hull when the thru hull is mounted thereon;

a drainage device mountable on the thru hull, the drainage device including a drainage device body, an inwardly projecting rim located at least partially around the drainage device body and shaped to fit around the lip protruding outwardly from the face of the flange, and a drainage lip protruding from the drainage device body;

wherein the inwardly projecting rim is shaped such that the drainage device is secured on the thru hull by locating the inwardly projecting rim around at least a portion of the lip protruding from the face of the flange of the thru hull.

2. The device for preventing staining of a boat hull of claim 1, further comprising one or more inwardly projecting tabs located around the drainage device body.

3. The device for preventing staining of a boat hull of claim 1, wherein the thru hull is formed of one of stainless steel and a hardened polymer.

4. The device for preventing staining of a boat hull of claim 1, wherein the drainage device is formed of a thermoplastic elastomer.

5. The device for preventing staining of a boat hull of claim 4, wherein the drainage device is formed of Santoprene.

6. The device for preventing staining of a boat hull of claim 1, further comprising a groove located between the lip protruding from the face of the flange and the flange, wherein the inwardly projecting rim fits within the groove when the drainage device is installed on the thru hull.

7. The device for preventing staining of a boat hull of claim 1, further comprising a downward projecting portion located on an underside of the drainage lip at an end of the drainage lip.

8. The device for preventing staining of a boat hull of claim 1, further comprising a drainage groove located on the drainage lip protruding from the drainage device body.

9. The device for preventing staining of a boat hull of claim 6, wherein a diameter of the lip is greater than an outer diameter of the groove.

10. The device for preventing staining of a boat hull of claim 9, further comprising an angled surface located between the lip protruding from the face and the groove.

11. The device for preventing staining of a boat hull of claim 1, wherein an inner diameter of the lip around an outlet of the thru hull is angled such that a diameter of the outlet increases towards a distal end of the lip.

12. The device for preventing staining of a boat hull of claim 1, wherein a diameter of the lip is less than an outer diameter of the flange.

13. The device for preventing staining of a boat hull of claim 1, further comprising a threaded portion located on the thru hull body.

14. The device for preventing staining of a boat hull of claim 13, further comprising a nut threadably engageable with the threaded portion located on the thru hull body for securing the thru hull body to the boat hull.

15. The device for preventing staining of a boat hull of claim 1, further comprising a flexible washer, wherein the flexible washer is located between an inner surface of the flange and the boat hull when the thru hull is installed on the boat hull.

16. The device for preventing staining of a boat hull of claim 1, the thru hull further comprising a barbed portion located on an opposite end of the thru hull body from the flange.

17. The device for preventing staining of a boat hull of claim 16, the barbed portion further comprising a slot formed therein.

18. The device for preventing staining of a boat hull of claim 16, wherein the barbed portion is secured to a conduit on the boat, and wherein a fluid from the conduit flows through the thru hull and is discharged on the drainage device at an outlet of the thru hull.

19. A device for preventing staining of a boat hull comprising:

a thru hull mountable through the boat hull, the thru hull including a thru hull body, a flange located on an end of the thru hull body, and a lip located around an outlet of the thru hull, the lip protruding outwardly from a face of the flange and away from the boat hull when the thru hull is mounted thereon;

a drainage device mountable on the thru hull, the drainage device including a drainage device body, an inwardly projecting rim located at least partially around the drainage device body and shaped to fit around the lip protruding outwardly from the face of the flange, one or more inwardly projecting tabs located around the drainage device body, and a drainage lip protruding from the drainage device body;

wherein the inwardly projecting rim is shaped such that the drainage device is secured on the thru hull by locating the inwardly projecting rim around at least a portion of the lip protruding from the face of the flange of the thru hull.

20. A device for preventing staining of a boat hull comprising:

a thru hull mountable through the boat hull, the thru hull including a thru hull body, a flange located on an end of the thru hull body a lip located around an outlet of the thru hull, the lip protruding outwardly from a face of the flange and away from the boat hull when the thru hull is mounted thereon, and a groove formed between the lip protruding from the face of the flange and the flange;

a drainage device mountable on the thru hull, the drainage device including a drainage device body, an inwardly projecting rim located at least partially around the drainage device body and shaped to fit around the lip protruding outwardly from the face of the flange, and a drainage lip protruding from the drainage device body;

wherein the inwardly projecting rim is shaped such that the drainage device is secured on the thru hull by locating the inwardly projecting rim around at least a portion of the lip protruding from the face of the flange of the thru hull; and wherein the inwardly projecting rim is shaped to fit within the groove of the thru hull when the drainage device is installed on the thru hull.

* * * * *